US005522514A

United States Patent [19]

Robinson

[11] Patent Number: 5,522,514

[45] Date of Patent: Jun. 4, 1996

[54] MODULAR STACKING SHELVES FOR UMBRELLA TABLES

[76] Inventor: David Robinson, 1147 W. Ohio St., Chicago, Ill. 60622

[21] Appl. No.: 352,872

[22] Filed: Dec. 9, 1994

[51] Int. Cl.[6] ..... A47F 5/00

[52] U.S. Cl. ..... 211/188; 211/107; 211/186; 108/94; 108/151

[58] Field of Search ..... 211/107, 144, 211/188, 186; 108/150, 151, 183, 92, 93, 94, 101

[56] References Cited

U.S. PATENT DOCUMENTS

| | | | |
|---|---|---|---|
| 906,458 | 12/1908 | Oren | 211/107 X |
| 1,225,793 | 5/1917 | Fischer | 108/94 X |
| 1,257,107 | 2/1918 | Patterson | 211/107 |
| 1,918,056 | 7/1933 | Platt | 108/94 |
| 2,103,684 | 12/1937 | Long | 211/188 X |
| 3,194,403 | 7/1965 | Van Horn | 211/107 |
| 3,620,174 | 11/1971 | Dentino | 108/151 |
| 3,624,732 | 11/1971 | Bowden | 108/151 X |
| 4,011,954 | 3/1977 | Galli | 211/188 X |
| 4,501,201 | 2/1985 | Fitzner et al. | 211/107 X |
| 4,708,256 | 11/1987 | Intardonato | 220/23.4 |
| 5,277,488 | 1/1994 | Cleary et al. | 211/144 X |
| 5,322,023 | 6/1994 | Hammond | 108/50 |
| 5,335,803 | 8/1994 | O'Brien | 211/163 |

*Primary Examiner*—Robert W. Gibson, Jr.
*Attorney, Agent, or Firm*—Don Moyer

[57] ABSTRACT

Any number of generally identical shelves can be formed from any pair of generally identical semicircular shelf halves by removably attaching the shelf halves along the straight edge which subtends the semicircle. Each shelf half has an aperture in the straight edge concentric with the semicircle so that the shelf halves can be removably attached while encircling an umbrella table pole. A higher shelf is supported above a lower shelf by a triplet of generally identical struts removably attached to the top side of a lower shelf and removably attached to the bottom side of a higher shelf in tripod formation. A triplet of generally identical arm struts can be removably attached to the top side of the highest shelf in tripod formation so that accessories such as lights or flowers can be hung from the arm strut horizontal arm which projects away from the pole. The lowest shelf can be supported above the umbrella table surface by a space frame base, for example in the form of a right circular cylinder, or can be supported by the arm struts by attaching a triplet of arm struts to the bottom side of the lowest shelf in tripod formation so that the arms of the arm struts are positioned on and supported by the umbrella table surface.

17 Claims, 2 Drawing Sheets

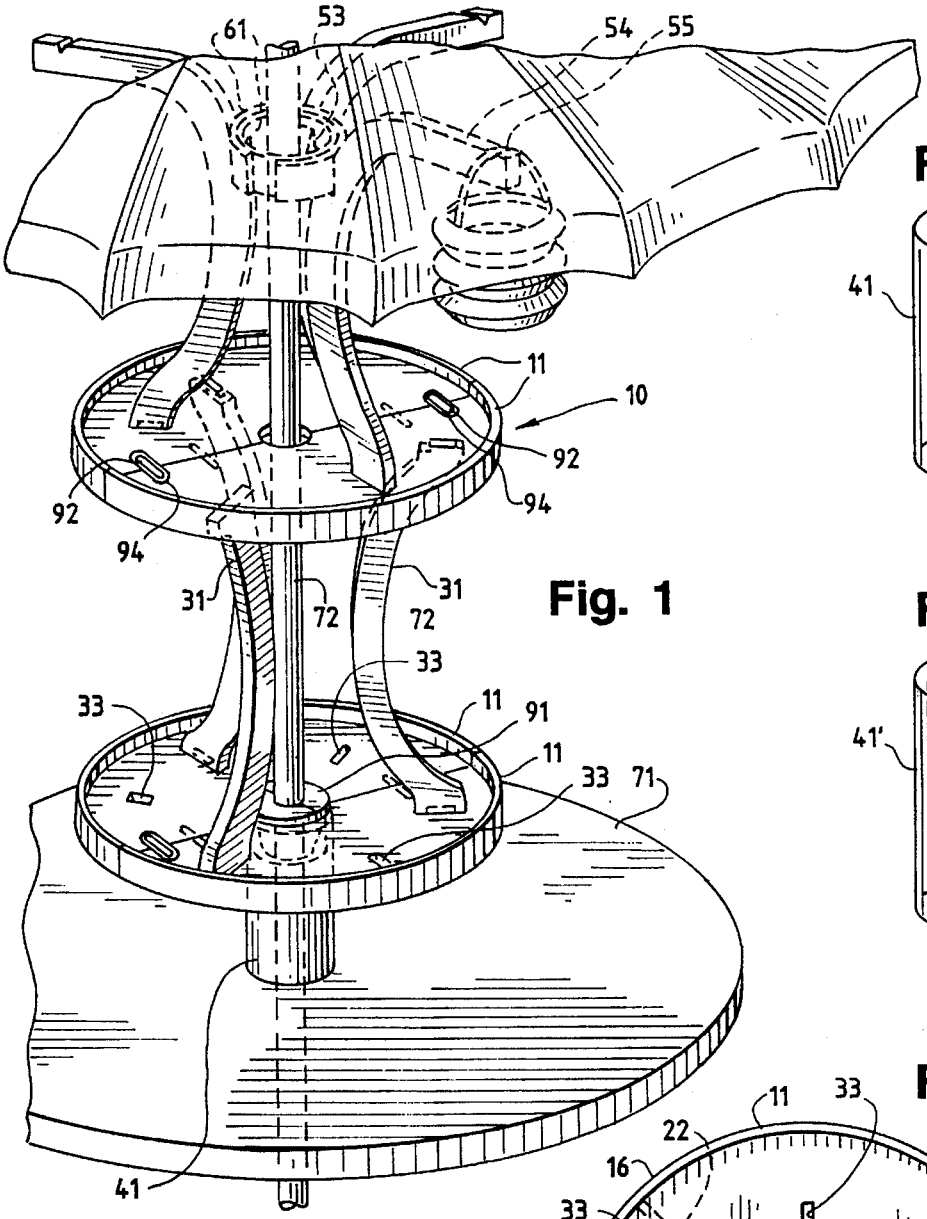
Fig. 1
Fig. 5
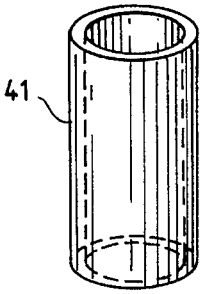
Fig. 6
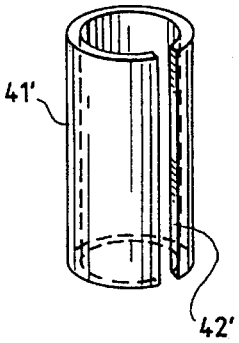
Fig. 2
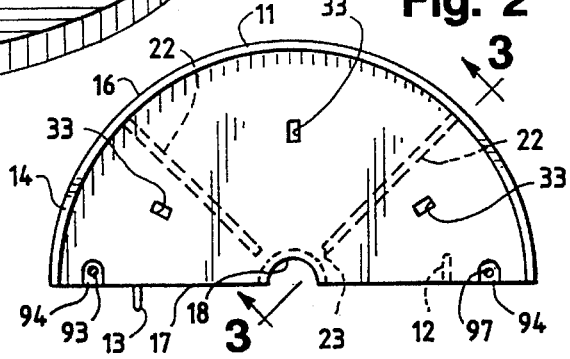
Fig. 4
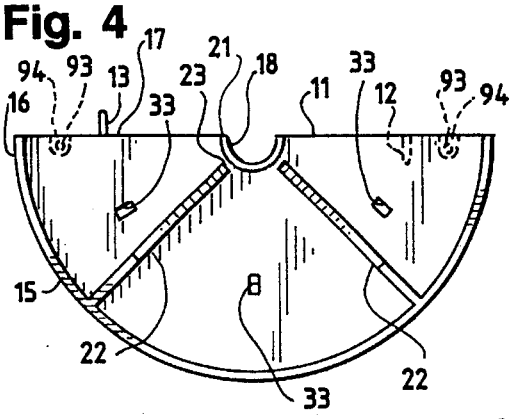
Fig. 3
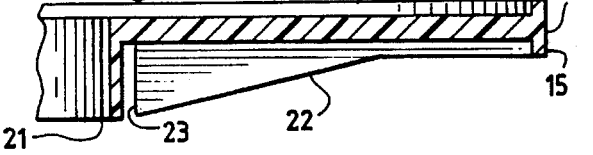

Fig. 7
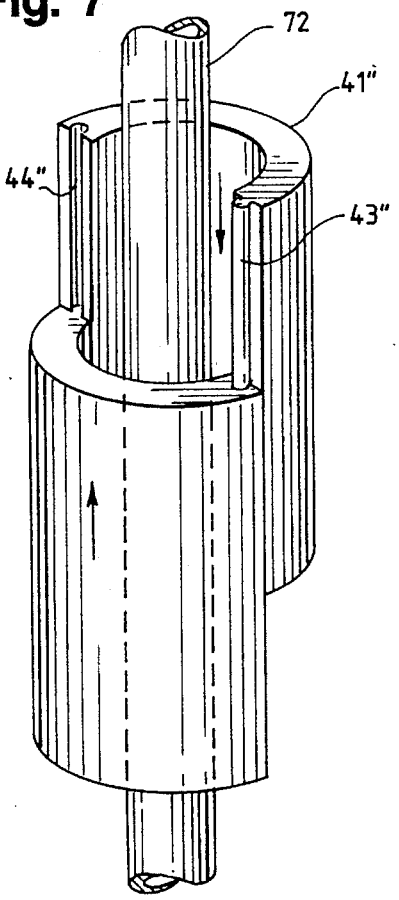
Fig. 8
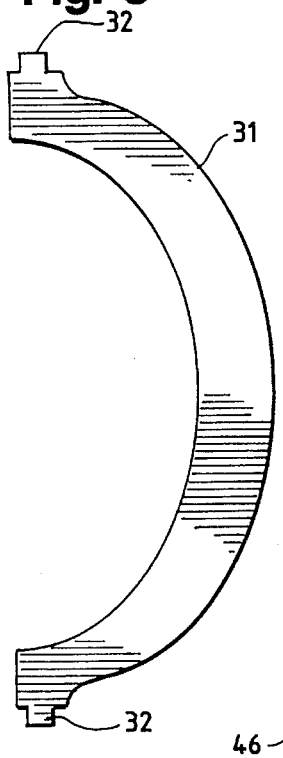
Fig. 9
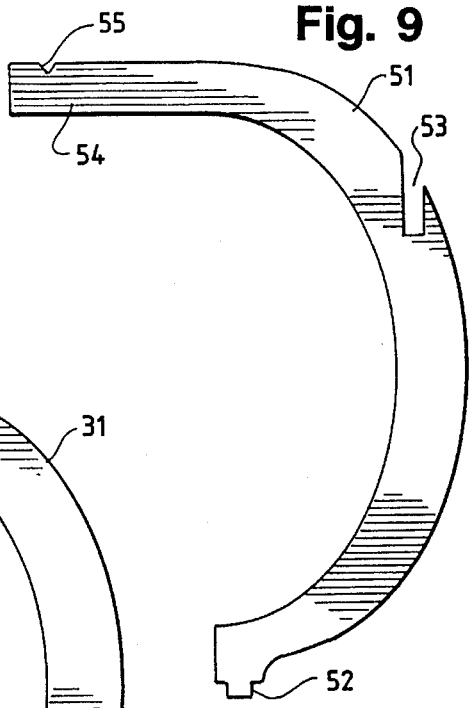
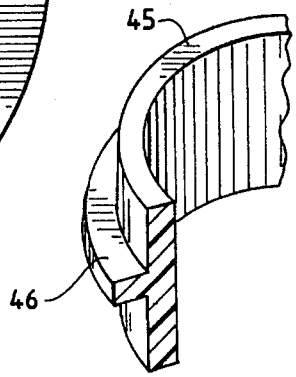
Fig. 13
Fig. 10
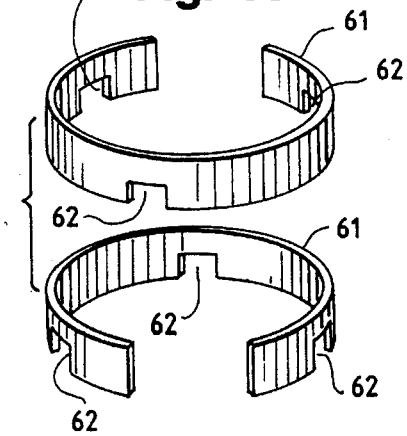
Fig. 11
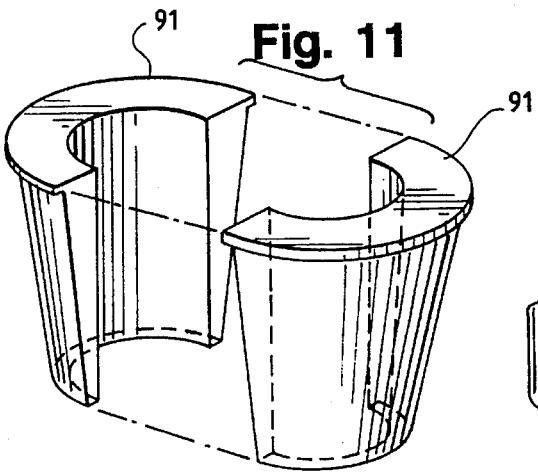
Fig. 12
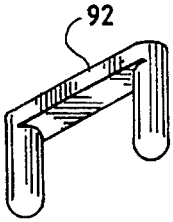

MODULAR STACKING SHELVES FOR UMBRELLA TABLES

BACKGROUND OF THE INVENTION

This invention relates to modular shelves which can be stacked above an umbrella table surface and stacked one above another, all encircling an umbrella table pole.

Umbrella tables are now common. They are regularly used on private verandas and back yards and are used in sidewalk cafes and other public places. In all cases additional useful space added to the umbrella table will enhance the use of the umbrella table.

Devices have been proposed which partially answer this opportunity. The device proposed in U.S. Pat. No. 4,708,256 by Intardonato is a compartmented rotatable tray which can rest upon the umbrella table surface. This tray is made of two parts which mate to encircle the pole. The device proposed in U.S. Pat. No. 5,322,023 by Hammond is also a compartmented rotatable tray which can rest upon the surface of the umbrella table surface. Here the tray has a removable section which allows the tray to encircle the pole. These two trays do make the available space more useful because of the compartments and rotatability, but they do not add new space. Also, in both cases the parts are not designed to minimize the number of different parts in order to increase the ease of manufacture and commercial appeal.

The specification of a rotatable tray proposed in U.S. Pat. No. 5,335,803 by O'Brien and O'Brien discloses a clamp for holding the rotatable tray onto the pole above the umbrella table surface. This specification also mentions a "pipe" for holding the rotatable tray above the umbrella table surface and for holding one rotatable tray above another rotatable tray but does not disclose how a "pipe" relates to two rotatable trays. The means required to make this tray rotatable, the stacking elements required to match the rotation means, and the means for easily attaching and detaching all these rotatable tray parts to the umbrella table would not be easy to manufacture at a price which has commercial appeal.

The device proposed in U.S. Pat. No. 1,257,107 by Patterson clamps plates to a tent pole to make a gun rack encircling the pole. This rack is clamped, braced, and rigged to accommodate rifles and does not answer the opportunities addressed here. The holder of detachable trays proposed in U.S. Pat. 3,194,403 by Van Horn is also clamped on a pole which could be an umbrella pole. The clamps disclosed by Van Horn when adapted to fit all umbrella table poles, to sustain likely loads, and for ease of use would entail manufacturing costs which would greatly reduce commercial appeal.

Thus, there are opportunities for new ways to add useful space to umbrella tables, using elements which are devised for ease of use, ease of manufacture, and commercial appeal.

SUMMARY OF THE INVENTION

Objects of this invention include the following. First, make modular stacking shelves which are formed of a minimum of parts all of which are easy to manufacture and easy to ship and stock. Second, make the parts easy to assemble so that shelves can be easily stacked on the umbrella table surface encircling the pole in various configurations which add to the useful space and make the umbrella table more attractive. Other objects of this invention will be seen in the detailed description, which will make additional objects obvious to those skilled in the art.

In summary, one embodiment of this invention comprises shelf halves which can be attached to make shelves encircling an umbrella table pole and comprises struts which hold the lowest shelf above the surface of the umbrella table, which hold higher shelves above lower shelves, and which hold accessories, such as lights, above the highest shelf.

Other embodiments will be seen in the detailed description, which will make additional embodiments obvious to those skilled in the relevant art.

DRAWING FIGURES

FIG. 1 is perspective view showing the modular stacking shelves in use on an umbrella table.

FIG. 2 is top view of a shelf half.

FIG. 3 is a partial cross section of a shelf half taken on the line 3—3 in FIG. 2.

FIG. 4 is the bottom view of a shelf half.

FIG. 5 is a perspective view of a base.

FIG. 6 is a perspective view of a variant base.

FIG. 7 is a perspective view of another variant base.

FIG. 8 is a side view of a strut.

FIG. 9 is a side view of an arm strut.

FIG. 10 is a perspective view of stabilizer collar halves.

FIG. 11 is a perspective view of stabilizer wedges.

FIG. 12 is a perspective view of a locking pin.

FIG. 13 is a perspective view of a base stacker element

DETAILED DESCRIPTION OF THE INVENTION

FIG. 1 shows the modular stacking shelves 10 in use on an umbrella table. A base 41 is removably positioned on and supported by an umbrella table surface 71. A pair of shelf halves 11—also shown in FIG. 2, FIG. 3, and FIG. 4—are removably attached along their straight edges 17 by removably seating each of the dowel pins 13 into the matching dowel seats 12. The shelf halves are held together by the lock pins 92—also shown in FIG. 12—removably seated into the respective lock pin seats 93 in the lock pin recesses 94. FIG. 1 shows the lowest shelf positioned on and supported by a base 41, with the base disposed in the base slot 23 on the bottom side of the shelf. The base slot 23 is the space between the central tube half 21 and the shelf braces 22, which are shown in FIG. 2, FIG. 3, and FIG. 4.

Any number of pairs of shelf halves can be attached and stacked exactly as described here. All shelf halves are generally identical, and all attached shelf halves form generally identical shelves which are classed as a lowest shelf, a lower shelf, a higher shelf, and a highest shelf according to their relation within the stack.

The shelf halves—detailed in FIG. 2, FIG. 3, and FIG. 4—match at their straight edge 17. Their semicircular edges 16 meet to form a full circle. Their apertures 18 match to encircle the pole. Each half shelf has mortises 33 at ninety degrees from the straight edge and at sixty degrees on either side of the ninety degree mortise. This gives a full shelf two triplets of mortises each in tripod formation to allow for multiple stacking. FIG. 2, FIG. 3, and FIG. 4 also show a central tube half 21, radial shelf braces 22, an upper lip 14, and a lower lip 15. These elements allow for the manufacture of strong shelves with minimal material. The upper lip also helps prevent spillage and the lower lip improves the appearance. FIG. 1 also shows stabilizer wedges 91 wedged between the pole and the aperture 18 in the lowest shelf to help stabilize the shelf. FIG. 11 shows the preferred, tapered, half cylindrical form 91 of stabilizer wedges which can help stabilize the shelf.

FIG. 2, FIG. 3, and FIG. 4 also show that each shelf half has a dowel seat 12 projecting into the thickness between the top side and the bottom side and a dowel 13 projecting out of the thickness, the dowel seat and the dowel are each located along the straight edge the same distance from the center of the semicircle in opposite directions. Thus any two shelf halves will match dowels to dowel seats along their straight edges so that they can be removably attached by removably seating each dowel into each dowel seat.

Continuing with FIG. 1, each of the tenons 32 on the lower end of each of a triplet of struts 31—which, as shown in FIG. 8, are symmetric so that the choice of end is unimportant—are removably fitted into each of a triplet of mortises 33 from the top side of the lower shelf in tripod formation. Each of the tenons 32 at the higher end of each of the triplet of struts 31 are removably fitted into each of a triplet of mortises 33 from the bottom side of the higher shelf in tripod formation. Struts are preferred because umbrella table poles often have devices, such as cranks for winding the umbrella to open or closed position, which will be easily bypassed by these struts. The struts 31 are arcuate so that they curve in toward the pole to increase the useful space in the span between shelves, the span being the plumb distance between the higher end of the strut and the lower end of the strut.

FIG. 1 also shows arm struts 51 which, as shown in FIG. 9, each have an arm 54 which is generally horizontal and have an attaching end with a tenon 52 integral to the attaching end. The arm strut thus can be removably fitted into the mortise 33 from the top side of the highest shelf. Each arm strut is arcuate and curves toward the pole before the arm strut segues to the arm which projects radially away from the pole in order to leave more useful space in the reach, the reach being the plumb distance from the arm to the attaching end. Each arm has a notch 55 from which accessories such as lights or flowers can be hung. Each of the tenons 52 of a triplet of arm struts are removably fitted into the triplet of mortises 33 from the top side of the highest shelf in tripod formation. A stabilizer collar 61 with a triplet of slots 62 trisecting the collar has been fitted into the triplet of arm strut stabilizer slots 53. As shown in FIG. 10 the stabilizer collar is made of two generally identical pieces, each in the form of a partial circle. These pieces are easily placed around the pole and rotated so that their slots 62 match but their openings do not match.

FIG. 1 shows the lowest shelf positioned on and supported by a base which in this the preferred case is of the form of a right-circular-cylinder space frame 41, which is also shown in FIG. 5. This base could be any other form of space frame which has a lower platform equivalent to the lowest right section of 41, which has a higher platform equivalent to the highest right section of 41, and a plumb distance between the higher platform and the lower platform equivalent to the rise of 41, the rise of 41 being the distance between the highest right section and the lowest right section of 41. The base could even be base struts. An example not shown could have the lowest shelf supported above the umbrella table surface 71 by using a triplet of arm struts 51 as base struts. The tenons 52 of the triplet of arm struts would be attached into the mortises from the bottom side of the shelf in tripod formation and the arms 54 would be positioned on and supported by the umbrella table surface. The stabilizer collar would link these base struts as described above and would be held in place by frictional forces acting where the collar engages the triplet of arm struts.

To stack the lowest shelf, the base 41 shown in FIG. 5 is preferred because it uses a minimum amount of space on the umbrella table surface. This base must be positioned on the umbrella table surface to encircle the pole when the pole is mounted on the umbrella table and remains there until the pole is demounted, which is no problem since it occupies so little space. FIG. 6 shows a variant of the base 41, Here there is a break 42' fully through the wall of the base and fully extending along the rise of the base. The base 41', is rigid vertically and resilient horizontally so that the base can be opened just wider than the diameter of the pole and positioned to encircle the pole whereupon the base resiliently closes. Another variant 41" is shown in FIG. 7. Here the base is made of any two generally identical half bases. Each half base is generally of the form of a right circular cylinder halved along a right-section diameter. Each half base has a mortise 43" projecting into one wall and extending along the rise of the half base and has a matching tenon 44" projecting out from the other wall and extending along the rise of the half base. Any two half bases can be positioned around the pole and the two mortise and tenon pairs removably slid together as shown in FIG. 7.

The preferred base 41 and the variants 41' and 41" could also be used to stack a higher shelf above a lower shelf. Base stacker elements 45, shown in FIG. 13, can link two bases in order to stack a higher shelf a greater distance above a lower shelf. The preferred form of the stacker element 45 is a right-section-chord-subtending portion of a right circular cylinder with an outer radius just less than the inner radius of the base 41 and has a ridge 46 with a radius just greater than the outer radius of the space frame 41. Stacker elements can be removably disposed between two bases so that the base stacker element ridges are positioned on and supported by the lower base while a higher base is positioned on and supported by the stacker element ridge.

Other means for stacking the lowest shelf along a pole, such as clamps and wedges; other means for stacking a higher shelf above a lower shelf along a pole, such as removably or permanently linking the struts to form a space frame; and other means for attaching shelf halves to encircle a pole, such as various mortise and tenon joins, will be obvious to people skilled in the art. It is understood therefore that this invention is not limited to the particular embodiments disclosed here.

I claim:

1. Modular stacking shelves comprising:

shelf elements, the shelf elements being in the form of a shelf half, the shelf half having a top side, a bottom side, and a thickness between the bottom side and the top side, the shelf half also having a generally semicircular edge and having a straight edge subtending the semicircle, the shelf half further having an aperture in the straight edge, the aperture being concentric with the semicircle, the aperture having a diameter larger than a diameter of an umbrella table pole, for detachably attaching a pair of shelf elements to form a generally circular generic shelf encircling the pole, the shelf being generic so that detachably attaching any pairs of shelf elements will form shelves which are all generally identical to the generic shelf, the shelves being classed as a lowest shelf, a lower shelf, a higher shelf, and a highest shelf according to their relation within a stack; and struts which are all generally identical and which have a lower end, a higher end, and a span, the span being the plumb distance between the higher end and the lower end, the lower end and the upper end of each of at least a triplet of the struts being removably attachable to the lower shelf and the higher shelf respectively for holding the higher shelf the span distance above the lower shelf along the pole, and the lower end of each of the triplet of struts being removably attachable to the lower shelf in tripod formation and the upper end of each of the triplet of the struts being removably attachable to the higher shelf in tripod formation for holding the higher shelf the span distance above the lower shelf along the pole.

2. The modular stacking shelves of claim 1 wherein the shelf half has mortises so that the generic shelf has a triplet of mortises in tripod formation, and wherein each of the struts has a tenon integral to the higher end and has a tenon integral to the lower end for removably fitting the tenon integral to the lower end of each of the triplet of the struts into each of the triplet of the mortises from the top side of the lower shelf in tripod formation and for removably fitting the tenon integral to the higher end of each of the triplet of the struts into each of the triplet of the mortises from the bottom side of the higher shelf in tripod formation.

3. The modular stacking shelves of claim 1 wherein each of the struts is arcuate for curving toward the pole and leaving more useful space above where the lower end of the strut is removably attached to the lower shelf.

4. The modular stacking shelves of claim 1 further comprising arm struts, each of the arm struts having an attaching end which can be removably attached to the top side of the shelf, having an integral arm which is generally horizontal and which can project away from the pole, and having a reach, the reach being the plumb distance between the attaching end and the arm.

5. The modular stacking shelves of claim 4 wherein there is a notch in the arm of each of the arm struts for hanging accessories.

6. The modular stacking shelves of claim 4 wherein the arm of each of a triplet of the arm struts can be removably positioned on and supported by the umbrella table surface and the attaching end of each of the triplet of the arm struts can be removably attached to the bottom side of the lowest shelf for holding the lowest shelf above the umbrella table surface.

7. The modular stacking shelves of claim 4 wherein the arm struts are arcuate for curving toward the pole and leaving more useful space between where the attaching end of the arm strut is removably attached to the shelf and where the arm projects away from the pole.

8. The modular stacking shelves of claim 4 wherein the attaching end of each of the arm struts has a tenon integral to the attaching end for detachably fitting into one of the mortises in the shelf.

9. The modular stacking shelves of claim 4 further comprising an arm strut stabilizer collar which can removably encircle the pole while being removably attached to the triplet of arm struts for stabilizing the triplet of arm struts.

10. The modular stacking shelves of claim 1 further comprising a base, the base having a lower platform, a higher platform, and a rise, the rise being the plumb distance between the higher platform and the lower platform, so that the lower platform can be removably positioned on and supported by the umbrella table surface and the lowest shelf can be removably positioned on and supported by the higher platform for removably holding the lowest shelf the rise distance above the umbrella table surface along the pole.

11. The modular stacking shelves of claim 10 wherein the base is a space frame generally rigid vertically and resilient horizontally, the space flame having a break fully along the rise, the brake for opening the space flame to a distance just greater than the diameter of the pole and removably disposing the space frame around the pole whereupon the space frame resiliently closes encircling the pole.

12. The modular stacking shelves of claim 10 wherein the base comprises a pair of generally identical base halves, each of the base halves being generally of the form of a right circular cylinder halved along a right-section diameter leaving on each of the base halves a first vertical wall edge and a second vertical wall edge, so that a pair of base halves can be removably coupled to form the base encircling the pole.

13. The modular stacking shelves of claim 12 wherein the first vertical wall edge has a mortise within the vertical wall and extending vertically along the vertical wall and the second vertical wall edge has tenon protruding from and extending vertically along the vertical wall, the mortise and tenon for removably coupling any two base halves while encircling the pole.

14. The modular stacking shelves of claim 10 further comprising base stacker elements, each of the stacker elements for removably linking the base to a second base, the second base being generally identical to the base, so that the base and the second base can together removably encircle the pole and can together removably hold the lowest shelf twice the rise distance above the umbrella table surface, and further together can hold a higher shelf twice the rise distance above a lower shelf along the pole.

15. The modular stacking shelves of claim 1 further comprising a dowel projecting out from the thickness at the straight edge of the shelf half and a dowel seat projecting into the thickness at the straight edge of the shelf half, the dowel and the dowel seat each being located at the same distance along the straight edge in opposite directions from the center of the semicircle, the dowel and dowel seat further each being perpendicular to the straight edge and parallel to the plane of the semicircle, the dowel and dowel seat for removably attaching any two shelf elements by removably seating each dowel into each dowel seat to form the generic shelf.

16. The modular stacking shelves of claim 15 wherein the shelf half has two lock pin seats, the lock pin seats projecting into the thickness from the top side near the straight edge, each lock pin seat being located at the same distance in opposite directions from the center of the semicircle, and wherein lock pins link two attached shelf elements, the lock pins having a first pin end which removably seats in one of the lock pin seats of one of the attached shelf elements, having a second pin end which removably seats in the corresponding one of the lock pin seats on the second of the two attached shelf elements, and having a body connecting the first pin end to the second pin end across the straight edge of the two attached shelf elements, and further wherein the shelf half has two lock pin recesses around each of the lock pin seats, each of the recesses being a generally spheroidal indentation projecting into the thickness from the top side and projecting into the thickness along the straight edge, the recess for receiving the lock pin body below the top side.

17. The modular stacking shelves of claim 1 further comprising stabilizer wedges which can be wedged between the pole and the aperture of the shelves to help stabilize the shelves.

* * * * *